US009447976B2

(12) United States Patent
Twardochleb et al.

(10) Patent No.: US 9,447,976 B2
(45) Date of Patent: Sep. 20, 2016

(54) FUEL INJECTOR WITH A DIFFUSING MAIN GAS PASSAGE

(71) Applicant: SOLAR TURBINES INCORPORATED, San Diego, CA (US)

(72) Inventors: Christopher Zdzislaw Twardochleb, Alpine, CA (US); Rasoul Z. Paydar, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 448 days.

(21) Appl. No.: 14/152,821

(22) Filed: Jan. 10, 2014

(65) Prior Publication Data

US 2015/0198333 A1 Jul. 16, 2015

(51) Int. Cl.
*F23R 3/28* (2006.01)
*F23R 3/14* (2006.01)

(52) U.S. Cl.
CPC ..... *F23R 3/286* (2013.01); *F23R 3/14* (2013.01); *F23C 2900/07001* (2013.01)

(58) Field of Classification Search
CPC ..... F23R 3/286; F23R 3/14; F23R 3/28; F23R 3/283; F23R 3/36; F23D 14/48; F23D 2204/10; F23D 2900/14021; F23K 5/002
See application file for complete search history.

(56) References Cited

U.S. PATENT DOCUMENTS 5,540,547 A 7/1996 Cole et al.
5,601,238 A 2/1997 Rawlins et al.
6,415,594 B1 * 7/2002 Durbin ..... F23R 3/286 60/748
6,848,260 B2 2/2005 North et al.
6,959,535 B2 11/2005 Mancini et al.
7,703,288 B2 4/2010 Rogers
2003/0131600 A1 * 7/2003 David ..... F23D 11/107 60/737
2004/0250547 A1 * 12/2004 Mancini ..... F23D 11/107 60/740
2007/0044477 A1 * 3/2007 Held ..... F23D 11/24 60/776
2007/0169486 A1 7/2007 Hernandez et al.
2007/0269757 A1 * 11/2007 Commaret ..... F23R 3/10 431/265
2008/0308654 A1 * 12/2008 Pelletier ..... F23R 3/286 239/494
2011/0296840 A1 * 12/2011 Turrini ..... F23R 3/286 60/747
2012/0186083 A1 7/2012 Hernandez et al.
2012/0204571 A1 * 8/2012 Kraemer ..... F23D 14/48 60/776
2012/0304650 A1 * 12/2012 Hernandez ..... F23R 3/14 60/737
2012/0305673 A1 * 12/2012 Matsuyama ..... F23R 3/343 239/533.2

(Continued)

FOREIGN PATENT DOCUMENTS

GB 2134184 A 8/1984

OTHER PUBLICATIONS

Fox et al. "Flow Regimes in Curved Subsonic Diffusers", ASME Journal of Basic Engineering, 1962, pp. 303-312, vol. 84.

*Primary Examiner* — William H Rodriguez
(74) *Attorney, Agent, or Firm* — Procopio, Cory, Hargreaves & Savitch LLP

(57) ABSTRACT

A fuel injector for a combustor of a gas turbine engine is disclosed. The fuel injector includes a gas gallery and a gas passage. The gas gallery is an annular passage configured to circumferentially distribute gas fuel. The gas passage includes an inlet and an outlet. The inlet is distal to the gas gallery and includes an inlet area with a circular shape. The outlet adjoins the gas gallery and includes an outlet area including an annular sector shape. The gas passage is configured to diffuse the gas fuel and discharge the gas fuel from the outlet and into the gas gallery.

20 Claims, 4 Drawing Sheets

(56) References Cited

U.S. PATENT DOCUMENTS

2013/0340438 A1* 12/2013 Abreu ..... F02C 7/222
60/772

2014/0331676 A1* 11/2014 Cramb ..... F23R 3/14
60/740

* cited by examiner

FUEL INJECTOR WITH A DIFFUSING MAIN GAS PASSAGE

TECHNICAL FIELD

The present disclosure generally pertains to gas turbine engines, and is more particularly directed toward a fuel injector with a diffusing main gas passage.

BACKGROUND

Gas turbine engines include compressor, combustor, and turbine sections. Low Wobbe gas fuels for gas turbine engines may require higher volumetric flow for the same heat input. A loss in velocity head of a Low Wobbe gas fuel may negatively affect combustion.

U.S. Pat. No. 6,848,260 to D. North discloses a combustor for a gas turbine engine with a premix pilot fuel stage in order to reduce the emission of oxides of nitrogen from the engine. An in-service engine may be modified to add the premix pilot fuel stage by delivering premix pilot fuel to a ring manifold for tip-feeding a premix pilot fuel outlet member such as a swirler vane or fuel peg. In this manner, complex and expensive components such as the top hat, support housing and diffusion pilot burner assembly may be used without modification. Thermal stresses caused by the differential cooling of the ring manifold by the premix fuel pilot are reduced by a heat shield installed within the manifold.

The present disclosure is directed toward overcoming one or more of the problems discovered by the inventors or that is known in the art.

SUMMARY OF THE DISCLOSURE

In one embodiment, the fuel injector includes a gallery enclosure and a main body adjacent the gallery enclosure. The gallery enclosure forms a gas gallery. The gas gallery is an annular passage configured to circumferentially distribute a gas fuel. The main body includes a gas passage. The gas passage includes and inlet distal to the gas gallery and an outlet adjoining the gas gallery. The inlet includes an inlet area with a circular shape. The outlet includes an outlet area including an annular sector shape. The gas passage transitions from the inlet area to the outlet area and is configured to diffuse the gas fuel and discharge the gas fuel from the outlet and into the gas gallery.

DETAILED DESCRIPTION

The systems and methods disclosed herein include a fuel injector with a diffusing gas passage extending between the main gas tube and the gas gallery. In embodiments, the gas passage includes an inlet with a circular cross-section and an outlet with annular sector cross-section. The gas passage may include an elliptical path and a turning angle greater than 0 degrees and up to 90 degrees. The diffusing gas passage with the elliptical path may prevent or reduce a loss in gas velocity head of gas discharged into the gas gallery.

Figure 1:
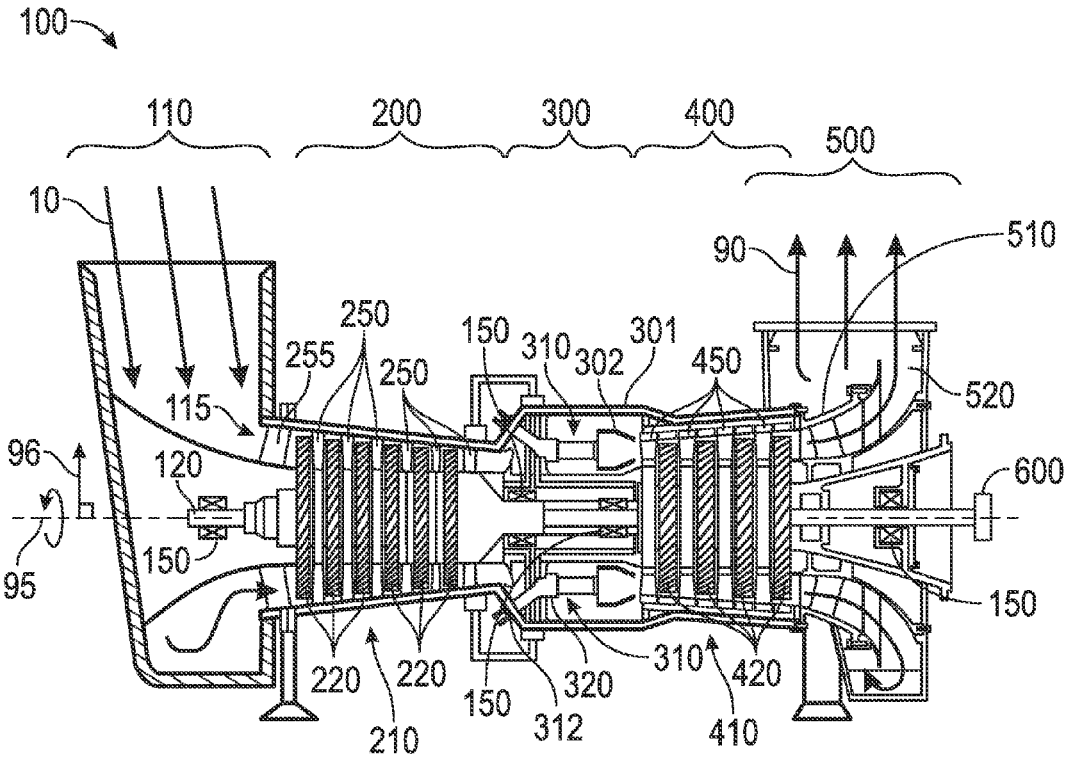
FIG. 1 is a schematic illustration of an exemplary gas turbine engine.

FIG. 1 is a schematic illustration of an exemplary gas turbine engine 100. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from center axis 95, wherein a radial 96 may be in any direction perpendicular and radiating outward from center axis 95.

A gas turbine engine 100 includes an air inlet 110, a shaft 120, a compressor 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor stationary vanes (stators) 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the compressor stages.

The combustor 300 includes one or more combustion chambers 302, one or more fuel injectors 310, and a combustor case 301 located radially outward from the combustion chamber 302. Each fuel injector 310 includes an injector head 320 adjacent the combustion chamber 302, a flange 312 adjacent the combustor case 301, and a stem 311 extending between flange 312 and injector head 320.

The turbine 400 includes a turbine rotor assembly 410 and turbine nozzles 450. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with single crystal turbine blades 430. Turbine nozzles 450 axially precede each of the turbine disk assemblies 420. Each turbine disk assembly 420 paired with the adjacent turbine nozzles 450 that precede the turbine disk assembly 420 is considered a turbine stage. Turbine 400 includes multiple turbine stages.

The exhaust 500 includes an exhaust diffuser 510 and an exhaust collector 520. The power output coupling 600 may be located at an end of shaft 120.

Figure 2:
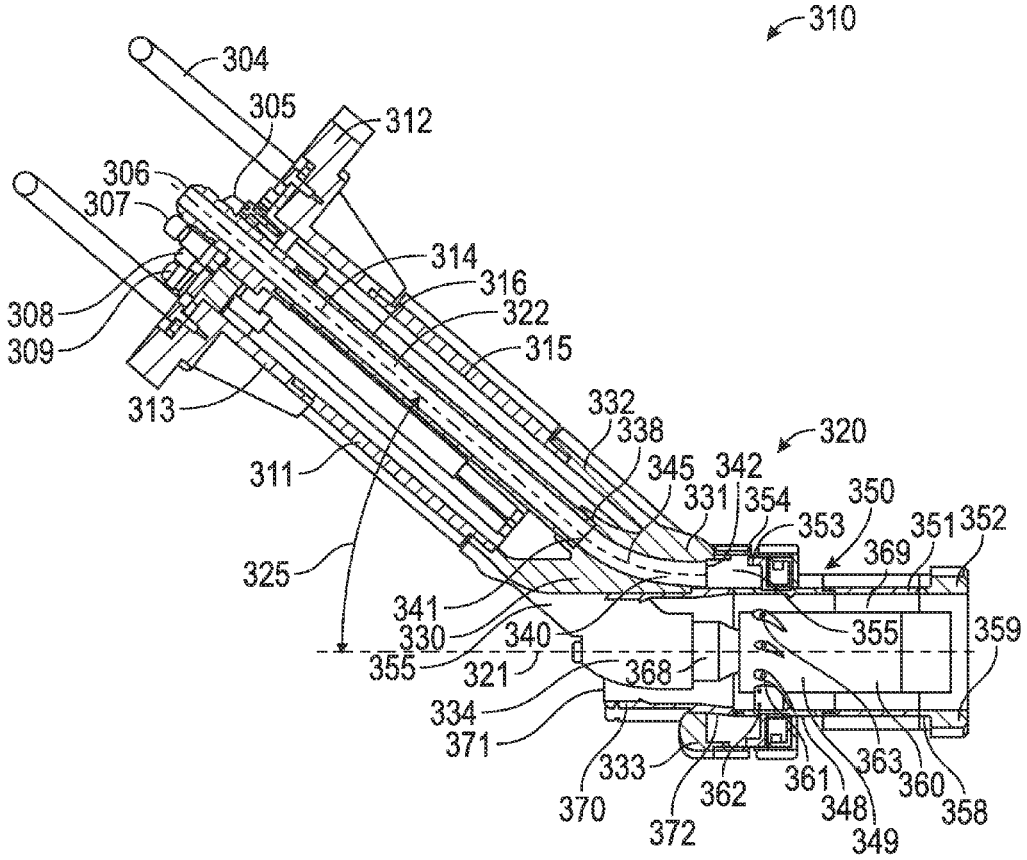
FIG. 2 is a partial cut-away view of a fuel injector for the combustor of FIG. 1.

FIG. 2 is a partial cut-away view of a fuel injector 310 for the combustor 300 of FIG. 1. In the embodiment illustrated, fuel injector 310 is a dual fuel injector. In other embodiments, fuel injector 310 is a gas fuel injector. Referring to FIG. 2, flange 312 may be a cylindrical disk, a cuboid or other geometric shape and may be configured to affix fuel injector 310 to combustor case 301. Stem 311 may be a hollow cylinder shape. Stem 311 may include multiple pieces. In the embodiment illustrated, a flange stem portion 313 is an integral part of flange 312 and extends perpendicular to the cylindrical disk shape.

Fuel injector 310 includes multiple fuel/supply tubes extending between flange 312 and injector head 320. Fuel injector 310 may include gas main tube 316, liquid main tube 315, gas pilot tube 318, and other supply tubes such as tube 319 and a liquid pilot tube. Each fuel/supply tube may connect to a fitting connected to flange 312, such as gas main fitting 306, liquid main fitting 305, gas pilot fitting 308, liquid pilot fitting 307, and supply fitting 309. Each fitting may be connected to a fuel source, a source of compressed air, etc.

Gas main tube 316 forms a main gas passage 322 and may include a gas main tube axis 314. Gas main tube 316 may connect to injector head 320 at an angle 325 from zero degrees to ninety degrees, angle 325 being the angle between gas main tube axis 314 and an injector head axis 321 of injector head 320. In some embodiments, angle 325 is from thirty-five degrees to forty-five degrees. In the embodiment illustrated, the angle 325 is forty degrees. The injector head axis 321 may be parallel to center axis 95. The other fuel/supply tubes, such as liquid main tube 315, gas pilot tube 318, and liquid pilot tube 317 may also connect to injector head 320 at angle 325.

Figure 3:
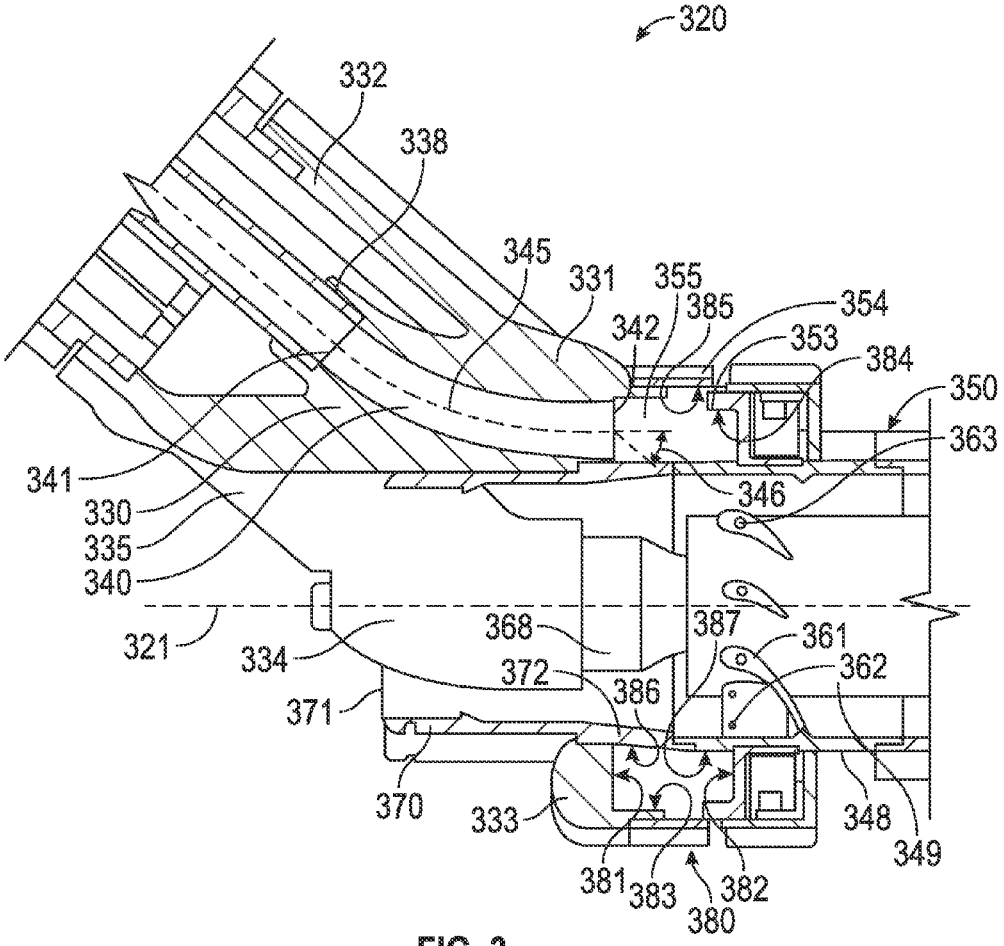
FIG. 3 is a cut-away view of the main body of the fuel injector of FIG. 2.

FIG. 3 is a detailed view of FIG. 2. Referring to FIGS. 2 and 3, injector head 320 is configured to include a gas gallery 355 and a gas passage 340. Gas gallery 355 may be ring shaped passage, such as an annular passage. Gas passage 340 connects/fluidly couples main gas passage 322 to gas gallery 355. Gas passage 340 includes an inlet 341, an outlet 342, and a mean camber line 345. The cross-sectional area of gas passage 340 increases from inlet 341 to outlet 342 along the length of the mean camber line 345.

Gas passage 340 may include a turning angle 346. Turning angle 346 is the angle that the flow turns from inlet 341 to outlet 342 measured at the mean camber line 345. The turning angle 346 may also be defined as the angle between the normal of the inlet cross-sectional area and the normal of the outlet cross-sectional area. Turning angle 346 may be the same angle as angle 325. In one embodiment, turning angle 346 is greater than zero degrees and up to ninety degrees. In another embodiment, turning angle 346 is greater than zero degrees and up to forty degrees. In yet another embodiment, turning angle 346 is forty degrees.

Gas passage 340 may be configured to redirect gas fuel traveling in a direction of the gas main tube axis 314 to a direction parallel to the injector head axis 321. Mean camber line 345 may be angled parallel to gas main tube axis 314 at the inlet 341 and may be angled parallel to injector head axis 321 at the outlet 342.

Injector head 320 may include a main body 330, an inlet shroud 370, a center body 350, a first gallery shroud 353, and a second gallery shroud 354. Portions of main body 330, inlet shroud 370 center body 350, first gallery shroud 353, and second gallery shroud 354 may form a gallery enclosure 380. The gallery enclosure 380 may define the annular shape of gas gallery 355.

Main body 330 may include a body portion 331, a body stem portion 332, a gallery portion 333, a strut 335, and a funnel 334. Body portion 331 may adjoin both body stem portion 332 and gallery portion 333. In the embodiment illustrated, body portion 331 is configured to include gas passage 340. Body portion 331 may include a gas main connection 338 and a liquid main connection 339 (shown in FIG. 3). Gas main connection 338 may be located within the body stem portion 332 and may be a protrusion formed with a cylindrical hole adjoining inlet 341 and may be sized to receive an end of gas main tube 316. The cylindrical hole may include a diameter larger than that of inlet 341. Liquid main connection 339 may be adjacent gas main connection 338. Liquid main connection 339 may include a counterbore sized to receive an end of liquid main tube 315.

Body stem portion 332 may extend from body portion 331 at angle 325 and may include a hollow cylinder shape. Body stem portion 332 may be metalurgically bonded to stem 311. The diameters and thickness of body stem portion 332 may be the same or similar to the diameters and thickness of stem 311.

Gallery portion 333 includes a ring like annular shape, a solid of revolution such as a toroid about an axis. The axis may be coaxial to injector head axis 321. Gallery portion 333 may form a second or aft end of the main body 330. Gallery portion 333 may extend circumferentially from body portion 331 and may include outlet 342.

Gallery portion 333 may include a first axial boundary 381 and a first outer circumferential boundary 383. The first axial boundary 381 may be an annular surface facing in the axial direction of gallery portion 333 and injector head axis 321. First axial boundary 381 may be an axial surface of gas gallery 355. Outlet 342 may be located at first axial boundary 381. The first outer circumferential boundary 383 may be a cylindrical surface and may form a portion of the outer circumferential boundary of gas gallery 355. The first outer circumferential boundary 383 may extend in the axial direction of gallery portion 333 and injector head axis 321.

Strut 335 may extend from body portion 331 at angle 325 towards injector head axis 321. Funnel 334 may be connected to strut 335 distal to body portion 331. Funnel 334 may include a funnel shape. The funnel shape may revolve about or be axially aligned with injector head axis 321. Funnel 334 may redirect pilot liquid and gas fuel from the gas pilot tube 318 and the liquid pilot tube 317 into a pilot shroud 368.

Inlet shroud 370 may be located radially outward from pilot shroud 368 and radially inward from gallery portion 333. Inlet shroud 370 may include a hollow cylinder shape. Inlet shroud 370 may include a an inner gallery portion 372 that adjoins a radially inner portion of gallery portion 333 and extends axially from gallery portion 333 forming a portion of the radially inner boundary of gas gallery 355. Inner gallery portion 372 may diverge at the end adjacent gallery portion 333. Inner gallery portion 372 may include a first inner circumferential boundary 386. The first inner circumferential boundary 386 may be a circumferential surface on the radially outer portion of the inner gallery portion 372 that is a radially inner surface of the gas gallery 355. Inlet shroud 370 may also include an air inlet 371 distal to the gallery portion 333.

Center body 350 may include an outer wall 348, an inner wall 349, and swirler vanes 361. Outer wall 348 may adjoin inlet shroud 370 at the end of inner gallery portion 372 and may extend axially from inlet shroud 370. Outer wall 348 may include a hollow cylinder shape. The end portion of Outer wall 348 adjoining inlet shroud 370 may form the remainder of the radially inner boundary of gas gallery 355 and may include a second inner circumferential boundary 387 axially adjacent first inner circumferential boundary 386.

Inner wall 349 is located radially inward from outer wall 348. Inner wall 349 may also include a hollow cylinder shape. Inner wall 349 and outer wall 348 may form a portion of premix duct 369. Premix duct 369 may be an annular passage where fuel and air is mixed prior to combustion.

Swirler vanes 361 may be located proximal an end of outer wall 348 and an end of inner wall 349. Swirler vanes 361 extend radially between outer wall 348 and inner wall 349. Each swirler vane 361 may include an airfoil shape with a vane passage 363 extending radially within and one or more injection holes extending from a leading edge of the airfoil to the vane passage 363. Each vane passage 363 may extend through outer wall 348 and may be in flow communication with gas gallery 355.

First gallery shroud 353 may be a ring like shape, such as a toroid or annulus and may be axially spaced apart from gallery portion 333. First gallery shroud 353 may be located radially outward from outer wall 348 and may radially adjoin outer wall 348. The cross-sectional shape of first gallery shroud 353 may include a vertical wall extending radially from center body 350 with a radially outer leg extending towards the gallery portion 333 and a radially inner leg extending away from the gallery portion 333 along outer wall 348. First gallery shroud 353 may form a portion of the radially outer boundary of gas gallery 355 and the axially boundary of gas gallery 355 opposite gallery portion 333. The vertical wall of first gallery shroud 353 may include a second axial boundary 382 offset from first axial boundary 381. Second axial boundary 382 may be an annular surface facing in the axial direction towards first axial boundary 381. The outer leg may include a second outer circumferential boundary 384. Second outer circumferential boundary 384 may be a circumferential surface extending axially towards gallery portion 333.

Second gallery shroud 354 may radially adjoin gallery portion 333 and first gallery shroud 353 and may include a hollow cylinder shape extending across an axial space between gallery portion 333 and first gallery shroud 353. Second gallery shroud 354 may form the remainder of the outer boundary of gas gallery 355. Second gallery shroud 354 may include the third outer circumferential boundary 385. Third outer circumferential boundary 385 may be a circumferential surface extending axially between first outer circumferential boundary 383 and second outer circumferential boundary 384. Gas gallery enclosure 380 may be formed by first axial boundary 381, second axial boundary 382, first outer circumferential boundary 383, second outer circumferential boundary 384, third outer circumferential boundary 385, first inner circumferential boundary 386, and second inner circumferential boundary 387, thus defining gas gallery 355.

Injector head 320 may also include premix tube 351, barrel 352, inner premix tube 360, and swirler vanes 361. Premix tube 351 may include a hollow cylinder shape, may adjoin the end of center body 350 distal to inlet shroud 370, and may extend axially from center body 350. Barrel 352 may adjoin premix tube 351 distal to center body 350. Barrel 352 may include a barrel body 358 and a barrel flange 359. Barrel body 358 may be a hollow cylinder shape extending axially from premix tube 351. Barrel flange 359 may be a hollow cylinder shape located at the end of barrel body 358 distal to premix tube 351 and extending radially outward from barrel body 358.

Inner premix tube 360 extends within center body 350, premix tube 351, and barrel 352. Inner premix tube 360 may include an outer cylindrical surface. Inner premix tube 360 may form a portion of premix duct 369 with premix tube 351, and barrel 352, aft of center body 350. Inner premix tube 360 may be adjacent inlet shroud 370 and may extend axially from inlet shroud 370. Premix tube 351, barrel 352, and inner premix tube 360 may each axially align with injector head axis 321.

Figure 4:
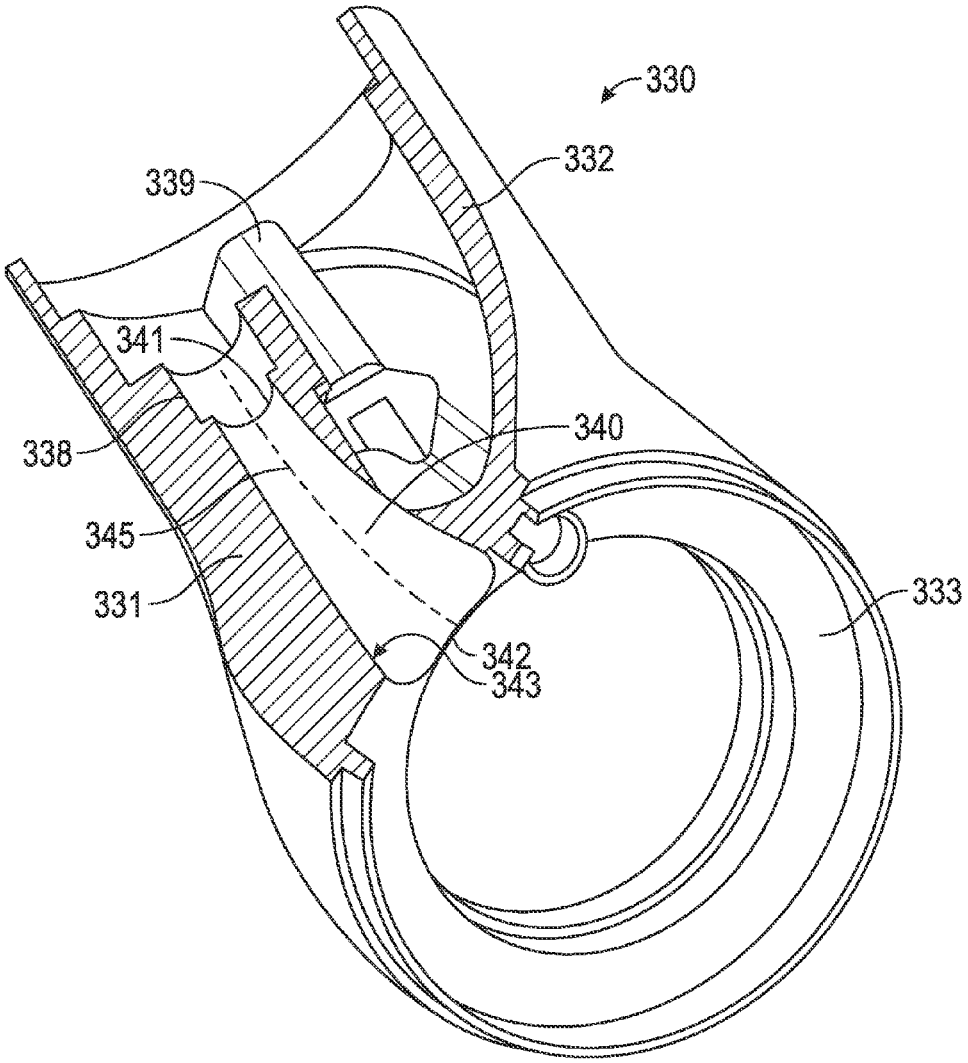
FIG. 4 is a front view of the main body of FIG. 3.

FIG. 4 is a cut-away view of the main body 330 of the fuel injector 310 of FIG. 2. The mean camber line 345 extending from inlet 341 to outlet 342 may follow an elliptical path from inlet 341 to outlet 342. The elliptical path may be configured to redirect the gas from the direction of the main gas passage 322 to the axial direction, a direction parallel to injector head axis 321 at turning angle 346. In some embodiments, the elliptical path may also twist/turn the mean camber line 345 in the circumferential direction relative to injector head axis 321. In one embodiment, the length of mean camber line 345 is from 7.24 cm (2.85 in.) to 7.62 cm (3.0 in.). In another embodiment, the length of mean camber line 345 is 7.44 cm (2.93 in.).

In some embodiments, the inlet cross-sectional area is from 1.21 $cm^2$ (0.188 $in.^2$) to 1.32 $cm^2$ (0.204 $in.^2$). In other embodiments, the inlet cross-sectional area is 1.26 $cm^2$ (0.196 $in.^2$). In the embodiment illustrated, the cross-sectional area of inlet 341 is a circle. In some embodiments, the ratio of the length of mean camber line 345 over the radius of inlet 341 is from 11.2 to 12.2. In other embodiments, the ratio of the length of mean camber line 345 over the radius of inlet 341 is 11.7.

Figure 5:
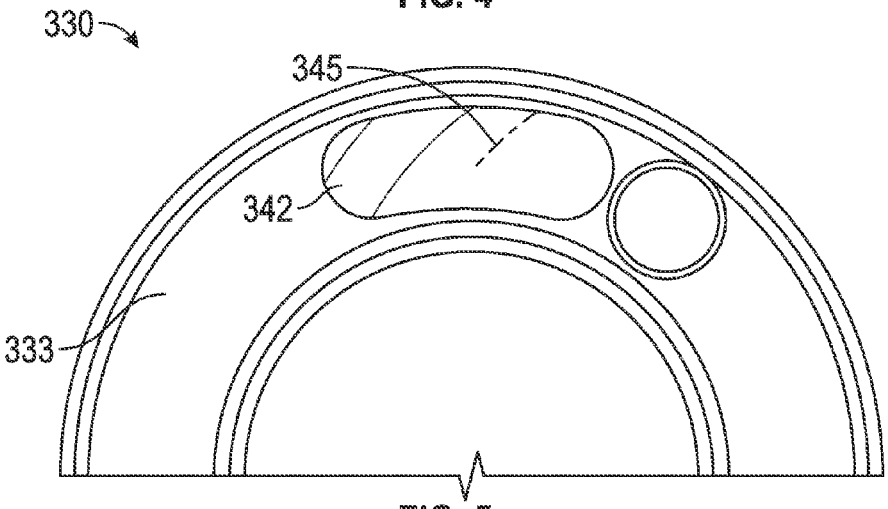
FIG. 5 is a front view of the main body of FIG. 3.

FIG. 5 is a front view of the main body 330 of FIG. 3. In some embodiments, outlet cross-sectional area is from 3.37 $cm^2$ (0.523 $in.^2$) to 3.66 $cm^2$ (0.567 $in.^2$). In other embodiments, outlet cross-sectional area is 3.52 $cm^2$ (0.545 $in.^2$). The outlet cross-sectional area may be an annular sector. The ends of the annular sector may be rounded. In the embodiment illustrated, the outlet cross-sectional area is an annular sector with rounded, capped ends. In some embodiments, the ratio of the outlet cross-sectional area over the inlet cross-sectional area is from 1 to 4.5. In other embodiments, the ratio of the outlet cross-sectional area over the inlet cross-sectional area is from 2.5 to 3. In yet other embodiments, the ratio of the outlet cross-sectional area over the inlet cross-sectional area is 2.78.

Referring to FIGS. 4 and 5, gas passage 340 includes a surface 343 which defines the shape of gas passage 340. Surface 343 is a smooth surface that transitions from the inlet cross-sectional area of inlet 341 to the outlet cross-sectional area of outlet 342 along mean camber line 345. Surface 343 also generally diverges from the mean camber line 345 from inlet 341 to outlet 342.

Gas passage 340 is a diffuser and is configured to diffuse the gas fuel from inlet 341 to outlet 342 and discharge the gas fuel into the gas gallery 355. The shape of the gas passage 340 may also be defined by the effective total divergence angle. The effective total divergence angle for a curved diffuser may be defined as:

$$2\theta_{eff} = 2\tan^{-1}\left((A_r - 1)\frac{R}{N}\right)$$

Where $2\theta_{eff}$ is the effective total divergence angle, $A_r$ is the area ratio of the cross-sectional area of outlet 342 over the cross-sectional area of inlet 341, R is the radius of inlet 341, and N is the length of the mean camber line 345. In one embodiment, the effective total divergence angle is between 0 degrees and 10 degrees. In another embodiment, the effective total divergence angle is from 6.0 degrees to 6.5 degrees. In yet another embodiment, the effective total divergence angle is 6.3 degrees.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, alloy x, INCONEL, WASPALOY, RENE alloys, HAYNES alloys, alloy 188, alloy 230, INCOLOY, MP98T, TMS alloys, and CMSX single crystal alloys.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the air inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the air inlet 110 towards the exhaust 500). Likewise, each turbine disk assembly 420 may be associated with a numbered stage.

Once compressed air 10 leaves the compressor 200, it enters the combustor 300, where it is diffused and fuel is added. Gas or liquid fuel may be used. Air 10 and fuel are injected into the combustion chamber 302 via fuel injector 310 and combusted. Energy is extracted from the combustion reaction via the turbine 400 by each stage of the series of turbine disk assemblies 420. Exhaust gas 90 may then be diffused in exhaust diffuser 510, collected and redirected. Exhaust gas 90 exits the system via an exhaust collector 520 and may be further processed (e.g., to reduce harmful emissions, and/or to recover heat from the exhaust gas 90).

Referring to FIGS. 2-5, when gas fuel is used, a gas fuel passage may direct the gas fuel from a supply line, such as gas main tube 316, and into an annular manifold, such as gas gallery 355 to distribute the gas fuel to the swirler vanes 361 and mixed with the compressed air. The gas fuel discharging into the annular manifold from the gas fuel passage may result in a significant loss of gas velocity head. When a low Wobbe gas fuel is used, which may require a higher volumetric flow rate for the same heat input, the discharge may result in almost a total loss of the gas velocity head.

Gas passage 340 may be used to direct the gas fuel from gas main tube 316 to gas gallery 355. Gas passage 340 may diffuse the gas fuel along an elliptical path, which may minimize the loss of gas velocity head as the gas fuel is discharged into the gas gallery 355. Gas passage 340 may also be slightly twisted to avoid a liquid fuel tube. Gas passage 340 may twist from inlet 341 to outlet 342 in a circumferential direction relative to injector head axis 321. The area of inlet 341, the area of outlet 342, and the length of mean camber line 345 may be configured to reduce the losses of gas velocity head in gas passage 340 while preventing the gas fuel from stalling in the gas passage 340.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular fuel injector, it will be appreciated that the fuel injector in accordance with this disclosure can be implemented in various other configurations, can be used with various other types of gas turbine engines, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. An injector head of a fuel injector for a combustor of a gas turbine engine, the injector head comprising:
- a gallery enclosure forming a gas gallery, the gas gallery being an annular passage configured to circumferentially distribute a gas fuel; and
- a main body adjacent the gallery enclosure, the main body including
  - a gas passage with
    - an inlet distal to the gas gallery, the inlet including an inlet cross-sectional area with a circular shape, and
    - an outlet adjoining the gas gallery and in fluid communication with the inlet, the outlet including an outlet cross-sectional area with an annular sector shape,
    - wherein the gas passage cross-section transitions from the inlet cross-sectional area to the outlet cross-sectional area and is configured to diffuse the gas fuel and discharge the gas fuel into the gas gallery.

2. The injector head of claim 1, wherein the gas passage includes a mean camber line with an elliptical curve.

3. The injector head of claim 2, wherein the gas passage includes an effective total divergence angle between 0 degrees and 10 degrees.

4. The injector head of claim 3, wherein a ratio of the outlet cross-sectional area over the inlet cross-sectional area is from 1 to 4.5.

5. The injector head of claim 4, wherein a second ratio of a length of the mean camber line over a radius of the inlet is from 11.2 to 12.2.

6. The injector head of claim 1, wherein the outlet cross-sectional area includes a circular cap at each end of the annular sector shape.

7. The injector head of claim 1, wherein the outlet cross-sectional area is from 3.37 $cm^2$ to 3.66 $cm^2$.

8. A main body of an injector head of a fuel injector for a combustor of a gas turbine engine, the main body comprising:
- a body stem portion including a hollow cylinder shape;
- a body portion adjoining the body stem portion, the body portion including a gas main connection located within the hollow cylinder shape of the body stem portion;

a gas passage including an inlet adjoining the gas main connection, the inlet including a circular cross-section, an outlet in fluid communication with the inlet, the outlet including a cross-section with an annular sector shape with circular capped ends, and a mean camber line extending from the inlet to the outlet with an elliptical curve, wherein the gas passage diverges from the mean camber line while extending from the inlet to the outlet; and a gallery portion with an annular shape adjoining the body portion distal to the body stem portion, the gallery portion including a first axial boundary facing in an axial direction of gallery portion, the first axial boundary being an annular surface and including the outlet of the gas passage.

9. The main body of claim 8, wherein the inlet includes a ratio of a length of the mean camber line over a radius of the inlet is from 11.2 to 12.2.

10. The main body of claim 9, wherein a ratio of the outlet cross-sectional area over the inlet cross-sectional area is from 2.5 to 3.

11. The main body of claim 9, wherein the gas passage includes an effective total divergence angle from 6 degrees to 6.5 degrees, smoothly transitioning from the circular cross-section of the inlet to the cross-section with the annular sector shape having circular capped ends of the outlet.

12. The main body of claim 8, wherein the gas passage includes a turning angle greater than 0 and up to ninety degrees.

13. The main body of claim 8, wherein the cross-section of the outlet is from 3.37 $cm^2$ to 3.66 $cm^2$.

14. A fuel injector for a combustor of a gas turbine engine, the fuel injector comprising:

a flange;

a gas main fitting connected to the flange and configured to couple to a gas fuel source;

a gas main tube coupled to the gas main fitting and extending along a first axis;

an injector head spaced apart from the flange and extending along a second axis angled from 35 degrees to 45 degrees relative to the first axis, the injector head including a main body including a body portion including a gas main connection coupled to the gas main tube distal to the fitting, and a gallery portion coaxial to the second axis and extending from the body portion in a circumferential direction, forming a ring shape, an inlet shroud including an inner gallery portion adjoining the gallery portion and located radially inward from the gallery portion, a center body including an outer wall extending from the inner gallery portion, the outer wall including a first hollow cylinder shape, an inner wall located radially inward from the outer wall, the inner wall including a second hollow cylinder shape, and swirler vanes extending radially between the outer wall and the inner wall, each swirler vane including a vane passage extending radially, a gas gallery formed by a gallery enclosure including a portion of the gallery portion, a portion of the inner gallery portion, and a portion of the outer wall, the gas gallery being an annular passage in flow communication with each vane passage, and a gas passage including an inlet adjoining the gas main connection and in flow communication with the gas main tube, the inlet including an inlet cross-sectional area with a circular shape, an outlet adjoining and in flow communication with the gas gallery, the outlet including an outlet cross-sectional area including an annular sector shape, and a mean camber line extending from the inlet to the outlet, wherein the gas passage diverges from the mean camber line and transitions smoothly from the inlet to the outlet.

15. The fuel injector of claim 14, wherein the mean camber line is angled parallel to the first axis at the inlet and parallel to the second axis at the outlet.

16. The fuel injector of claim 14, wherein the gas passage includes an effective total divergence angle from 6 degrees to 6.5 degrees.

17. The fuel injector of claim 14, wherein the mean camber line twists from the inlet to the outlet in a circumferential direction relative to the second axis.

18. The fuel injector of claim 14, wherein the mean camber line is an elliptical curve extending from the inlet to the outlet.

19. The fuel injector of claim 14, wherein a ratio of the outlet cross-sectional area over the inlet cross-sectional area is from 2.5 to 3.

20. A gas turbine engine including the fuel injector of claim 14.

* * * * *